United States Patent [19]

Guest et al.

[11] Patent Number: 4,558,625

[45] Date of Patent: Dec. 17, 1985

[54] BANJO MUTE

[76] Inventors: Donald K. Guest; George Spector, both of 233 Broadway, Rm. 3615, New York, N.Y. 10007

[21] Appl. No.: 633,867

[22] Filed: Jul. 23, 1984

[51] Int. Cl.[4] ..... G10D 3/04

[52] U.S. Cl. ..... 84/273

[58] Field of Search ..... 84/269–273, 84/411 M, 310–311

[56] References Cited

U.S. PATENT DOCUMENTS 1,454,923 5/1923 Grover ..... 84/273

4,246,825 1/1981 Hodas ..... 84/411 M

FOREIGN PATENT DOCUMENTS 8043 of 1905 United Kingdom ..... 84/273

*Primary Examiner*—Lawrence R. Franklin

[57] ABSTRACT

A mute for a banjo that has a parchment belly, a hoop, a peripheral flange, a resonator and a bridge. The mute consists of a supporting device adjustably carried by a platform spaced from the resonator. The supporting device is adapted to bear against the parchment belly under the bridge. Thumbscrews are carried by the flange for adjusting the platform.

2 Claims, 4 Drawing Figures

BANJO MUTE

BACKGROUND OF THE INVENTION

The instant invention relates generally to stringed musical instruments and more specifically it relates to a banjo mute.

Numerous stringed musical instruments have been provided in prior art that are adapted to have mute structures. For example U.S. Pat. Nos. 1,454,923; 3,015,247 and 3,797,355 all are illustrative of such prior art. While these units may be suitable for the particular purpose to which they address, they would not be suitable for the purpose of the present invention as heretofore described.

SUMMARY OF THE INVENTION

A principle object of the present invention is to provide a banjo mute that is installed within the banjo resonator to control the vibrations of the bridge.

Another object is to provide a banjo mute that can change the tone of the banjo from a soft regulated sound to a total muted sound.

An additional object is to provide a banjo mute that is controlled by two thumbscrews each having a ball and socket joint and bubble level to properly align the lifter plate under the bridge.

A further object is to provide a banjo mute that is simple and easy to use.

A still further object is to provide a banjo mute that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
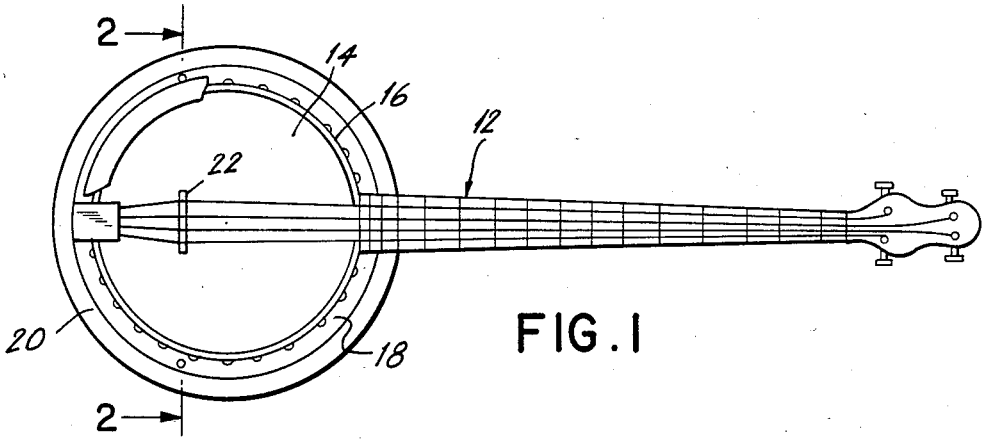
FIG. 1 is a top plan view of a banjo utilizing the invention.
Figure 2:
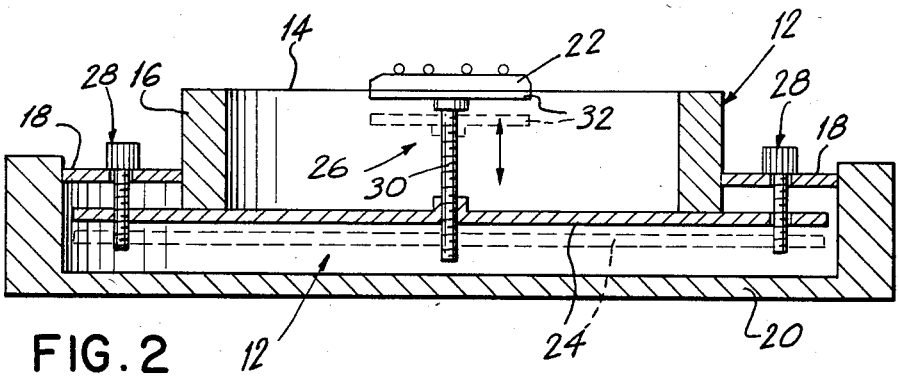
FIG. 2 is an enlarged simplified cross sectional view taken along line 2—2 in FIG. 1.
Figure 3:
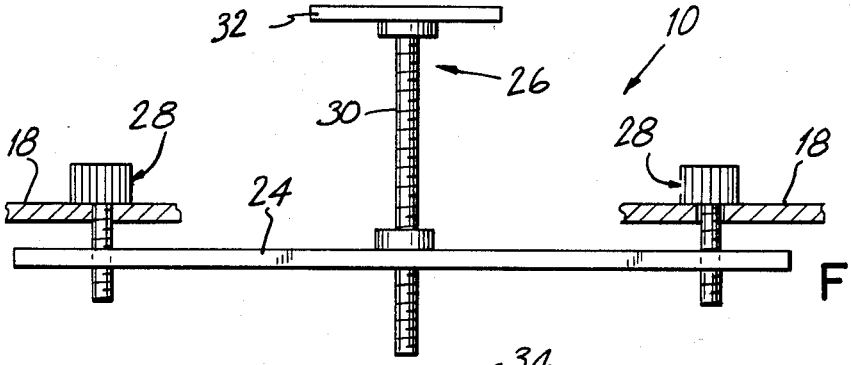
FIG. 3 is a side view of the invention.

Turning now descriptively to the drawings, in which similar reference characters denote similar elements throughout the several views, FIGS. 1 through 3 illustrate a mute 10 for a banjo 12 that has a parchment belly 14 stretched over a hoop 16, a peripheral flange 18 about the hoop 16, a resonator 20 connected to the flange 18 and a bridge 22 on the parchment belly 14.

The mute 10 consists of a platform 24 spaced from the resonator 20, a supporting device 26 adjustably carried by the platform 24 and adapted to bear against the parchment belly 14 under the bridge 22 of the banjo 12 and two thumbscrews 28 for adjusting the platform 24. The thumbscrews 28 are carried by the flange 18.

The supporting device 26 consists of an upright threaded rod 30 threaded into middle of the platform 24 and a lifter plate 32 integral with the upper end of the rod 30. The plate 32 is adapted to bear against inner surface of a portion of the parchment belly 14 under the bridge 22 of the banjo 12.

Each thumbscrew 28 is threaded into each end of the platform 24 to move the lifter plate 32 on the rod 30 to change the tone of the banjo 12 from a soft regulated sound to a total muted sound.

Figure 4:
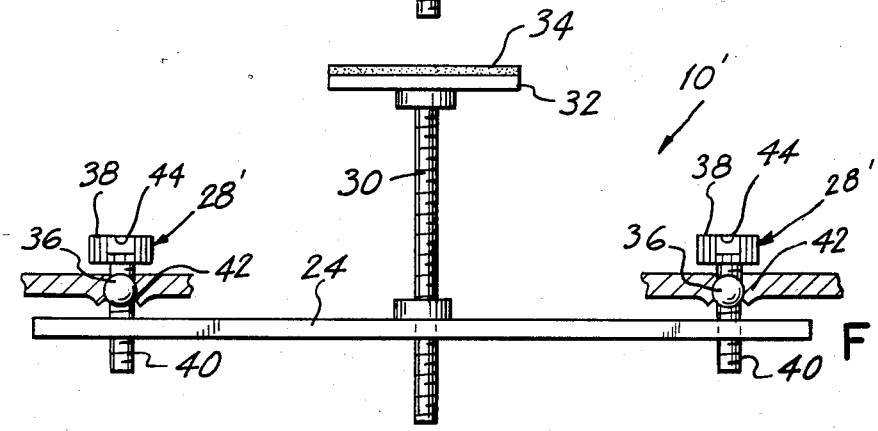
FIG. 4 is a side view of a modification showing the thumbscrew and flange forming a ball and socket joint with a bubble level in the head and the lifter plate with a resilient member thereon.

FIG. 4 shows a modified mute 10' wherein the lifter plate 32 contains a resilient member 34 to prevent slippage of the lifter plate 32 from the inner surface of the parchment belly 14.

Each thumbscrew 28' contains a ball 36 formed between head 38 and threaded shaft 40 so that the ball 36 is carried by the flange 18 forming a ball and socket joint 42 therein. A bubble level 44 is mounted in the head 38 so that the thumbscrew 28' will properly align the lifter plate 32 under the bridge 22.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A mute for a banjo having a parchment belly stretched over a hoop, a peripheral flange about said hoop, a resonator connected to said flange and a bridge on said parchment belly, said mute comprising:

(a) a platform spaced from said resonator;

(b) a supporting device adjustably carried by said platform and adapted to bear against said parchment belly under said bridge of said banjo; and (c) means for adjusting said platform, said means carried by said flange, wherein said supporting device comprises:

(a) an upright threaded rod threaded into middle of said platform; and (b) a lifter plate integral with upper end of said rod, said plate adapted to bear against inner surface of a portion of said parchment belly under said bridge of said banjo, wherein said means for adjusting said platform comprises a pair of thumbscrews, each thumbscrew having a head and shaft with a threaded portion, each said thumbscrew threaded into each end of said platform to move said lifter plate on said rod to change tone of said banjo from a soft regulated sound to a total muted sound wherein said lifter plate further comprises a resilient member to prevent slippage of said lifter plate from said inner surface of said parchment belly.

2. A mute as recited in claim 1, wherein each said thumbscrew further comprises:

(a) a ball formed integrally on its shaft between its head and said threaded shaft portion so that said ball is mounted on said flange forming a ball and socket joint therein; and (b) a bubble level mounted in each said head whereby said thumbscrews can be adjusted to properly align said lifter plate under said bridge.

* * * * *